US009038431B2

(12) United States Patent
Micklisch et al.

(10) Patent No.: US 9,038,431 B2
(45) Date of Patent: May 26, 2015

(54) HYDRAULIC CYLINDER FOR A HYDRAULIC DRAWING CUSHION

(75) Inventors: Michael Micklisch, Göppingen (DE); Markus Müller, Gebesee (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 764 days.

(21) Appl. No.: 13/068,054

(22) Filed: Apr. 29, 2011

(65) Prior Publication Data

US 2011/0265544 A1 Nov. 3, 2011

(30) Foreign Application Priority Data

May 3, 2010 (DE) ..... 10 2010 019 324

(51) Int. Cl.
*B21D 24/14* (2006.01)
*B21D 24/10* (2006.01)
(Continued)

(52) U.S. Cl.
CPC ..... *B21D 24/14* (2013.01); *B21D 24/10* (2013.01); *B21D 24/02* (2013.01); *F15B 11/036* (2013.01); *F15B 2211/6336* (2013.01); *F15B 2211/6651* (2013.01); *F15B 2211/6653* (2013.01); *F15B 2211/7055* (2013.01); *F15B 2211/76* (2013.01);
(Continued)

(58) Field of Classification Search
CPC ..... B21D 24/02; B21D 24/14; B21D 24/08; B21D 24/10; B21D 24/04
USPC ..... 72/453.13, 453.18, 351, 350, 453.06, 72/417, 432, 30.1, 349; 100/269.18, 100/269.19, 269.21, 259
See application file for complete search history.

(56) References Cited

U.S. PATENT DOCUMENTS 1,434,949 A * 11/1922 Glasner ..... 72/351
3,267,715 A * 8/1966 Williamson ..... 72/351
(Continued)

FOREIGN PATENT DOCUMENTS

DE 195 41 693 A1 5/1997
DE 196 39 222 A1 4/1998
(Continued)

OTHER PUBLICATIONS

Machine translation of JP 07-47195.*

*Primary Examiner* — Shelley Self
*Assistant Examiner* — Mohammad I Yusuf
(74) *Attorney, Agent, or Firm* — R. S. Lombard; K. Bach

(57) ABSTRACT

The invention resides in a hydraulic cylinder (23) for a hydraulic drawing cushion (20) of a drawing press (10). The hydraulic cylinder (23) includes a first operating chamber (47), a second operating chamber (48), and a third operating chamber (53). An annular piston (45) with a first piston surface area (49) and a second piston surface area (50) separates the first operating chamber (47) from the second operating chamber (48). The first and the second piston surfaces (49, 50) have the same size. A front surface of the piston rod (33) forms a third piston surface (54) which is larger than the first and second piston surfaces. The third piston surface (54) delimits the third operating chamber (53) of the hydraulic cylinder (23). The first and the second operating chambers (47, 48) are provided for controlling the position and/or the movement of the piston rod (33). The third operating chamber (53) serves to control the metal sheet clamping force of the drawing press via the piston rod (33).

13 Claims, 6 Drawing Sheets

(51) Int. Cl.
*B21D 24/02* (2006.01)
*F15B 11/036* (2006.01)

(52) U.S. Cl.
CPC ..... *F15B 2211/765* (2013.01); *F15B 2211/775* (2013.01)

(56) References Cited

U.S. PATENT DOCUMENTS 4,499,750 A * 2/1985 Gerber et al. ..... 72/351
7,197,910 B2 * 4/2007 Kodani ..... 72/453.13
7,739,894 B2 * 6/2010 Suzuki ..... 72/454
2009/0025449 A1 * 1/2009 Onishi ..... 72/351
2009/0078016 A1 * 3/2009 Suzuki ..... 72/20.1

FOREIGN PATENT DOCUMENTS

EP 0 074 421 A1 1/1983
EP 0 069 201 A2 3/1983
JP 63063533 A 2/1988
JP 63036931 A 3/1988
JP 07-47195 * 11/1995

* cited by examiner

HYDRAULIC CYLINDER FOR A HYDRAULIC DRAWING CUSHION

CROSS-REFERENCE TO RELATED APPLICATION

This application claims the priority of German Application No. 10 2010 019 324.0-14 filed May 3, 2010.

BACKGROUND OF THE INVENTION

The invention relates to a hydraulic cylinder for a hydraulic drawing cushion of a deep draw press.

During the drawing process, the drawing press clamps a metal sheet between an upper tool part and a lower tool part. By a relative movement between the upper tool part and the lower tool part, the metal sheet is pulled over a lower die and pressed between two die parts. The metal sheet retaining force required for the drawing is provided by the drawing cushion.

A drawing cushion for a drawing press is described, for example, in EP 0069 201 A2. The drawing cushion includes a cylinder which comprises three operating chambers. Two of the operating chambers operate pneumatically while the third operating chamber is in the form of a hydraulic operating chamber. The hydraulic operating chamber provides for the blocking of the drawing cushion in the lower end position and the controlling of the upward movement of the piston rod. The two pneumatic operating chambers are separated from each other by a differential piston. During the upward movement of the piston rod the two pneumatic operating chambers are placed in communications with each other, so that surface area difference of the differential piston becomes effective and moves the piston upwardly for the ejection of the formed metal part. This movement can be controlled by the oppositely acting hydraulic pressure in the hydraulic operating chamber.

Based hereon, it is the object of the invention to provide a compact hydraulic cylinder for a drawing cushion by which the position of the piston rod as well as the force provided by the piston rod can be controlled.

SUMMARY OF THE INVENTION

The present invention provides a hydraulic cylinder that comprises a cylinder housing with several operating chambers. In the cylinder housing, a piston rod is slidably supported which, at one front end projects from the cylinder housing. At the outer free end of the piston rod a floating plate is attached on which a metal sheet support ring is disposed. The metal sheet support ring applies during the drawing procedure the required drawing force to the metal sheet part to be deformed.

The hydraulic cylinder includes three hydraulically separated operating chambers. The first and second operating chambers are delimited each by a first and, respectively, a second piston surface area. Preferably, the two operating chambers are separated from each other by an annular piston. The first and second operating chambers have only a small volume and serve to bring the piston rod and, together therewith, the floating plate of the lower tool part into a desired position. In particular, with the hydraulic pressurization of the first and the second operating chamber, the movement and/or the position of the piston rod can be controlled. Because of the small first and second piston surface areas only a small fluid volume is required herefor.

In the cylinder housing preferably at the inner front of the piston rod, a third piston surface area is provided which is substantially larger than the first piston surface area and the second piston surface area. The third piston surface area may be larger than the two other piston surface areas by a factor of 3 to 10. The third piston surface area delimits a third operating chamber via which a metal sheet holding force is adjusted which is transmitted by the piston rod to the metal sheet holding ring. To this end, the hydraulic pressure in the third operating chamber is controlled to a predetermined desired pressure valve.

By means of the hydraulic operating chambers, the position and/or the movement of the piston rod and also the metal sheet holding force can be very accurately adjusted because the hydraulic medium is incompressible in contrast to gas media. Herein the position or, respectively the movement control of the piston rod and the control of the sheet metal holding force is assigned to different operating chambers. The piston surface area or, respectively, the chamber volume of the three operating chambers is therefore adapted to the functions assigned to the operating chambers. In this way a compact design of the hydraulic cylinder with a small diameter is achieved. An economical operation of the drawing cushion is ensured.

Preferably, the inner cylinder space of the cylinder housing which accommodates the piston rod is divided into two coaxially arranged cylindrical sections which join via an annular step. The first cylindrical section of the inner space has a larger diameter than the adjacent second cylindrical section. Preferably, the annular piston is arranged in the upper cylindrical section and divides the upper cylindrical section into the first and the second operating chamber. In the lower cylindrical section, the piston rod may delimit the third operating chamber. With such a design, the piston rod is a cylindrical component which can be manufactured very easily. Also, the two cylindrical sections can be formed in the cylinder housing by co-axial bores with little expenditures. Since all the operating chambers use the same hydraulic medium, small leakage flows between the operating chambers as they may occur, for example, after a longer operating time by a certain wear of the piston seals can be tolerated.

The third operating chamber is preferably hydraulically connected to a suction check valve which is arranged in particular parallel to a pressure control arrangement. Via the suction check valve, a volume increase of the third operating chamber during upward movement of the piston rod hydraulic medium is supplied to the third chamber with a small operating pressure of, for example, 5 to 15 bar so as not to inhibit the movement of the piston rod. The suction check valve blocks when the pressure in the third chamber increases or its volume is reduced so that, then, automatically, the parallel circuited pressure control arrangement becomes effective. With the suction check valve blocked, the pressure in the third operating chamber increases substantially over the intake operating pressure.

A deep draw press provided with the hydraulic cylinder according to the invention can operate very efficiently because for the movement of the piston rod only small hydraulic volume changes in the first and the second operating chambers are required. The large forces required for the engagement of the metal sheet are provided by the piston area of the third chamber. The pressure needed herefor in the third operating chamber is automatically generated by the inward movement of the piston rod. The floating plate of the drawing press may be supported by several of the hydraulic cylinders according to the invention. The position and/or the movement of the piston rods and/or the hydraulic pressure in the third operating chamber can be controlled in the various hydraulic cylinders independently of one another.

BRIEF DESCRIPTION OF THE DRAWINGS

Advantageous features of the invention are apparent from the drawings exemplary of the invention, in which.

DETAILED DESCRIPTION OF VARIOUS EMBODIMENTS

Figure 1:
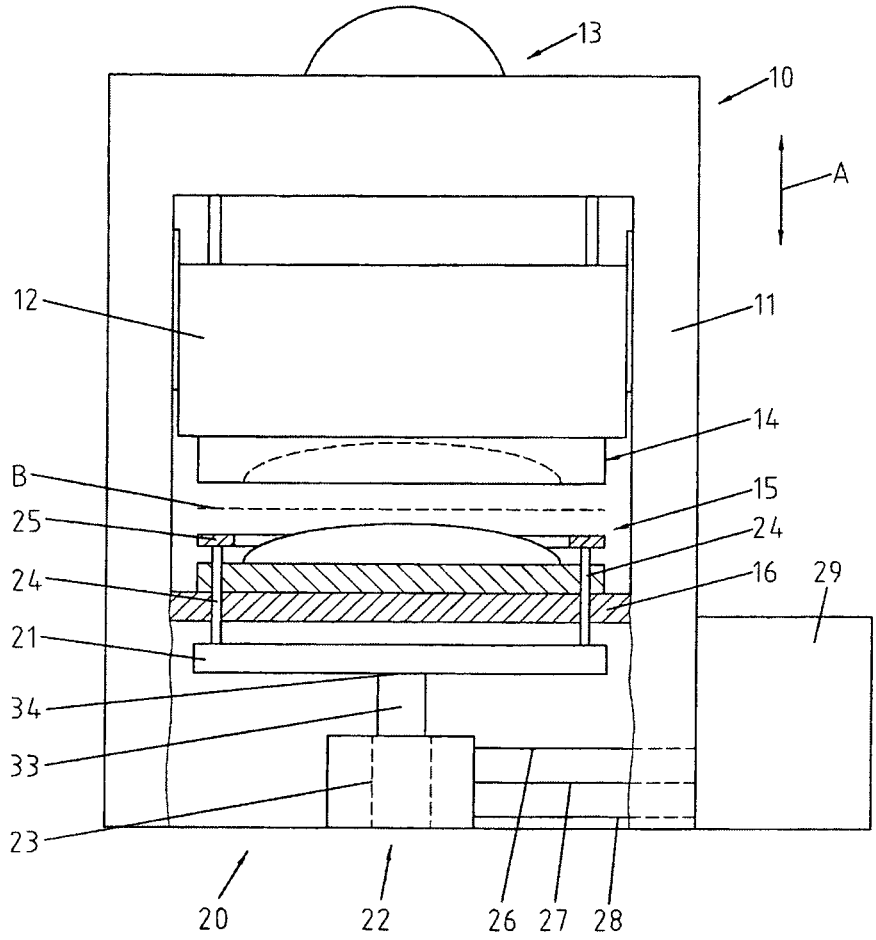
FIG. 1 shows a drawing press with a hydraulic drawing cushion in a schematic representation.

FIG. 1 shows a drawing press with a press frame in a schematic side view. On the press frame 11 a plunger 12 is supported so as to be movable in an operating direction A and in particular, in a vertical direction. A press drive 13 is provided for moving the plunger 12 in the operating direction. On the plunger 12 an upper tool part 14 is arranged.

In the operating direction A spaced from the upper tool part, a lower tool part 15 is disposed on a press table of the press frame 16.

Below the press table 16, the drawing press includes a hydraulic drawing cushion 20. The hydraulic cushion comprises a floating plate 21 which is supported on a cylinder arrangement 22 consisting of one or more hydraulic cylinders 23 so as to be displaceable in the operating direction A. At the side of the floating plate 21 opposite the cylinder arrangement 22, the floating plate 21 is connected to a metal sheet support ring 25 by way of pressure rods 24. The metal sheet support ring 25 can therefore be moved together with the pressure rods and the floating plate 24 by pressurizing the cylinder arrangement 22. Each hydraulic cylinder 23 of the cylinder arrangement 22 is in communication with the hydraulic circuit by way of a first hydraulic line 26, a second hydraulic line 27 and a third hydraulic line 28, so that hydraulic medium can be supplied to the hydraulic cylinder 23 and released from the hydraulic cylinder 22.

Figure 2:
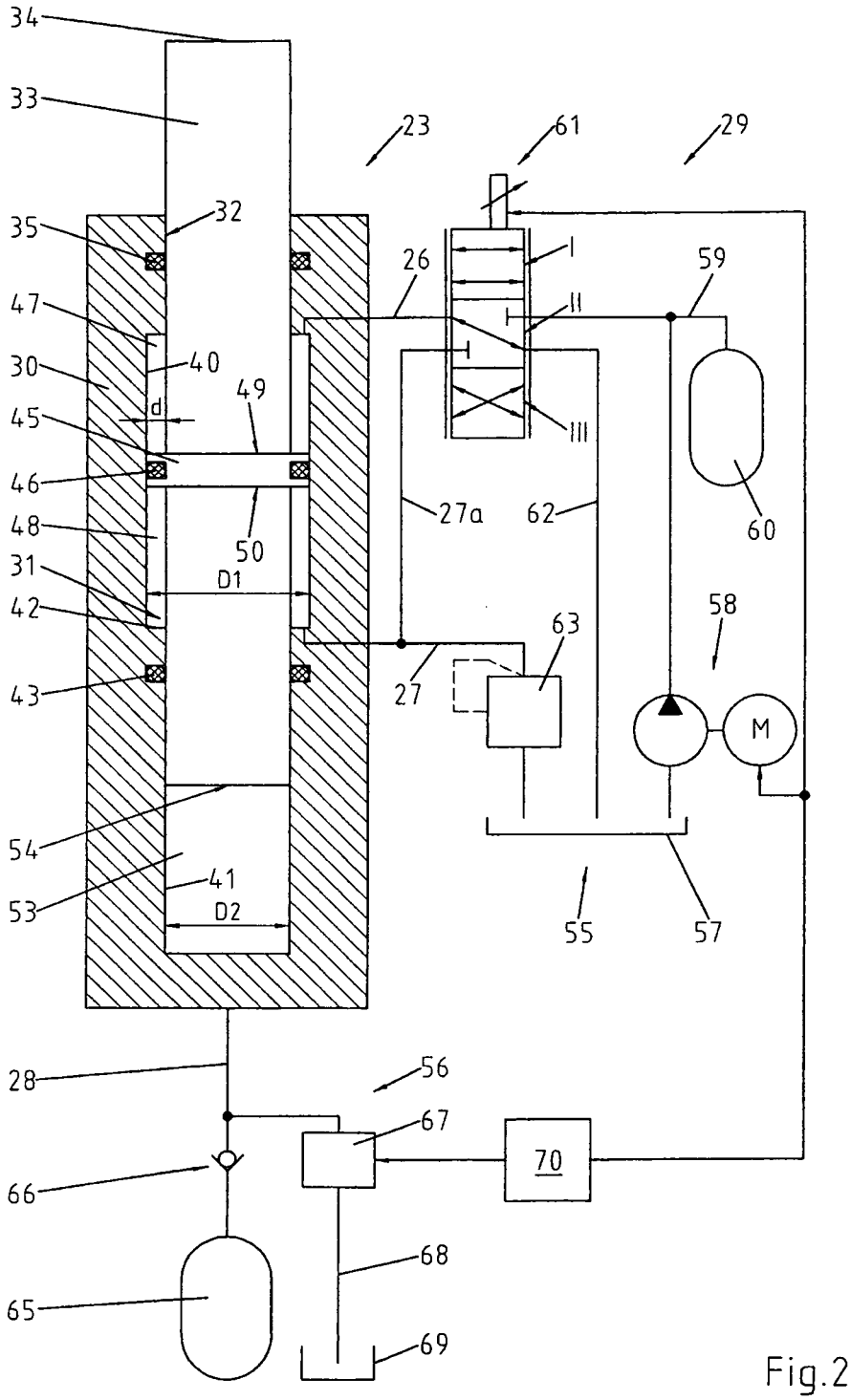
FIG. 2 shows schematically a hydraulic cylinder of a drawing cushion with a simplified hydraulic circuit.

One of the hydraulic cylinders 23 of the drawing cushion 20 as well as a highly simplified schematic representation of the connected hydraulic circuit 29 is shown in FIG. 2. The hydraulic cylinder 23 includes a cylinder housing 30 which delimits an internal cylinder space 31. The internal cylinder space 31 includes a cylindrical opening 32 through which a piston rod 33 which is slidably supported in the cylinder housing 30 projects with its outer free end 34 from the cylinder housing 30. At the outer end 34 of the piston rod 33, the floating plate 21 is attached. In the area of the cylindrical opening 32 a first seal arrangement 35 for the fluidic sealing of the internal cylinder space 31 is provided. The cylindrical opening 32 serves furthermore as guide structure for the movement of the piston rod 33 in the operating direction A.

The internal cylindrical space 31 includes adjacent the cylindrical opening 32 a first cylindrical section 40 with a first diameter D1. Following the first cylindrical section 40 there is a second cylindrical section 41 with a second diameter D2. The second diameter D2 is smaller than the first diameter D1. In the preferred exemplary embodiment, the second diameter D2 corresponds to the diameter of the cylindrical opening 32. Preferably, the piston rod 33 has, at least in the axial sections of the cylindrical opening 32 and of the second cylindrical section 41, a diameter which except for the necessary play, a diameter corresponding to the diameter D2.

The two cylindrical sections 40, 41 are joined via an annular step 42. Both cylindrical sections 40, 41 are arranged co-axial with the longitudinal axis of the piston rod 33. Next to the annular step 42, there is a second seal arrangement 43 in the inner wall of the second cylindrical section 41 which abuts the piston rod 33 in a fluid-sealing manner.

In the first cylindrical section 40, an annular piston 45 is attached to the piston rod 33. The annular piston 45 includes a piston seal 46 which sealingly abuts the inner wall of the first cylindrical section 40, whereby the first cylindrical section 40 is divided fluidically into a first operating chamber 47 and a second operating chamber 48. By axial movement of the annular piston 45 the volumes of the two operating chambers 47, 48 can be changed wherein however the sum of these volumes remains constant.

Adjacent the first operating chamber 47, the annular piston 45 has a first piston surface 49 and, adjacent the second operating chamber 48 a second piston surface 50. The first and the second piston surfaces have the same size.

In the second cylindrical section 41, a third operating chamber 53 is provided. The front face at the end of the piston rod 33 in the cylinder housing 30 forms a third piston surface 54 which delimits the third operating chamber 53. The surface area of the third piston surface 54 is larger than the surface area of the first and the second piston surfaces 49, 50. In the exemplary embodiment, the third piston surface 54 is three to ten and preferably five times as large as the first piston surface 49 or the second piston surface 50. The width d of the annular piston 45 in radial direction corresponds to the difference of the two diameters D1 (annular piston) and D2 (piston rod).

The first operating chamber 47 is connected to the hydraulic circuit via a first hydraulic line 26, the second operating chamber 48 via the second hydraulic line 27 and the third operating chamber 53 via the third hydraulic line 28. With the first and the second operating chamber 47, 48, a first hydraulic circuit 55 and with the third operating chamber, a second hydraulic circuit 56 is hydraulically connected. The two hydraulic circuits 55, 56 are fluidically completely separated from each other in the exemplary embodiment described here.

The first hydraulic circuit 55 includes a storage container 57 from which a motor-pump unit 58 sucks in hydraulic fluid and provides it via a pressure line 59. Connected to pressure line 59 is a pressure store 60 so that in the pressure line 59 there is always a sufficient amount of pressurized hydraulic medium available. Via an electrically controllable control valve 61, the pressure line 59 can be selectively connected to the first hydraulic line 26 or the second hydraulic line 27. Correspondingly, a return line 62 extending from the control valve 61 to the storage container 57 can be hydraulically connected via the control valve 61 selectively to the first or the second hydraulic line 26 or, respectively, 27. The second hydraulic line 27 is additionally connected to the storage container 57 via a pressure control valve 63. When the pressure in the second operating chamber 48 and, consequently, in the second hydraulic line 27 exceeds a predetermined threshold value, the pressure control valve 63 opens so that hydraulic medium can flow from the second operating chamber 48 to the storage container 57.

In the exemplary embodiment the control valve 61 is in the form of a 4/3 way valve. It may also be replaced by other arrangements such as, for example, two-way valves.

In a first switching position I, the first operating chamber 47 is connected to the pressure line 59 via the first hydraulic line 26 whereas the second operating chamber 48 is connected to the return line 62 via the second hydraulic line 27. In a second switching position II, the control valve 61 blocks the pressure line 59 and the branch connection 27*a* to the second hydraulic line 27 and connects the first hydraulic line 26 to the return line 62. The third switching position III provides for a hydraulic connection between the first operating chamber 47 and the return line 62 and between the second operating chamber 48 and the pressure line 59.

The second hydraulic circuit 56 includes a hydraulic reservoir 65 which is connected to the third hydraulic line 28 and which maybe in the form of a low pressure storage container. Via the hydraulic reservoir 65, the hydraulic medium is made available under a low pressure of about 5 to 15 bar. The hydraulic reservoir 65 is fluidically connected to the third hydraulic line 28 via a check valve 66. The check valve 66 permits in a suction operation, a fluid flow from the hydraulic reservoir 65 to the third operating chamber 53. In the opposite direction, the check valve 66 blocks during controlled pressure operation. Parallel to the check valve, an electrically controllable pressure control arrangement 67 is connected to the hydraulic line 28 via which the pressure in the third operating chamber 53 can be controlled during controlled pressure operation. The pressure control arrangement 67 may connect the third hydraulic line 28 to a storage container 69 via a return line 68. For controlling the pressure control arrangement 67 and the control valve 61 as well as the motor pump unit 58, a control unit 70 is provided.

In a modified exemplary embodiment, other than shown in FIG. 2, the two hydraulic circuits 55, 56 may be provided with a common storage container.

Via the first partial hydraulic circuit 55, the position and/or the movement are controlled, for example, the position and/or the speed and/or the acceleration of the piston rod 33. In the first switching position I, the first operating chamber 47 is connected to the pressure line 59 whereas the second operating chamber 48 is connected to storage container 57 and therefore is not pressurized. Because of the pressure difference at the opposite sides of the annular piston 45, a force is effective on the piston rod 33 which causes the piston rod 33 to move into the cylinder 23. In order to make the inward movement of the piston rod 33 possible, the third operating chamber 53 is connected, by means of the controllable pressure control arrangement 67, to the storage container 69 so that hydraulic medium can flow out of the third operating chamber 53.

In the third switching position III of the control valve 61, the piston rod 33 is caused to move out of the cylinder 23. The pressure in the second operating chamber 48 which exceeds that in the first operating chamber 47 generates a force on the annular piston 45 and consequently the piston rod 33 which causes outward movement of the piston rod 33. In the process, the volume of the third operating chamber 53 is increased and hydraulic medium flows into the third operating chamber 53 via the third hydraulic line 28 and the check valve 66 out of the hydraulic reservoir 65 in order not to prevent the movement of the piston rod 33 (supply suction operation). Because the first and the second piston surfaces 49, 50 are small also the volume flows to the first operating chamber 47 and out of the second operating chamber 48 or, respectively, vice versa are very small. The position and movement control of the piston rod 33 can therefore be achieved in a very efficient manner. By means of the control valve 61 and the first hydraulic circuit 55, for example, pre-accelerations of the metal sheet support ring 25 can be provided in order to reduce the relative speeds between the upper tool part 15 and the metal sheet support ring 25 before they meet. Also, an ejection movement of the formed metal part can be achieved by way of the first hydraulic circuit 55 and the first two operating chambers 47, 48.

During the drawing procedure, the sheet metal part B to be formed needs to be clamped between the metal sheet support ring 25 and the upper tool part 14 with a predetermined sheet metal holding force. In this clamped condition, the sheet metal part B is pulled by a continuous movement of the plunger 12 toward the lower tool part 15 over the shape of the lower tool part 15 and at the same time formed by the essentially complementary shape of the upper tool part 14. The sheet metal holding force needs to be maintained herein in order to ensure the quality of the part formed in the process. With an excessive holding force, the sheet metal may rupture. On the other hand, with an insufficiently large holding force folds may occur during the forming procedure.

The adjustment of the desired and required sheet metal holding force is achieved by the second holding circuit 56 and the third operating chamber 53 of the hydraulic cylinder 23. First, the cylinder 23 of the cylinder arrangement 22 are brought to their start-out positions. This occurs by movement of the annular piston 45 by supplying hydraulic medium to or from the first and the second hydraulic chambers 47, 48. The drawing cushion 20 is operated by position and/or movement control. Shortly before the upper tool part 14 abuts the metal sheet B disposed on the metal sheet support ring 25, an inward movement of the piston rod 33 can be initiated in order to reduce the relative speed between the plunger 12 and the metal sheet support ring 25.

As soon as the upper tool part 14 is disposed on the sheet metal part B the hydraulic drawing cushion 20 is switched over for a control of the metal sheet clamping force. To this end, the control valve 61 is moved to its second switching position II in which the first operating chamber 47 is connected to the return line 62 so that it is pressure free. The branch connection 27*a* from the second hydraulic line 27 to the control valve 61 is blocked, so that the second operating chamber 48 is connected via the pressure control valve 63 to the storage container 57. The press drive 13 tries to move the upper tool part 14 in the operating direction A toward the lower tool part 15. In the process, the pressure in the second and third operating chambers 48, 53 increases. Because of this pressure increase, the pressure control valve 63 opens so that hydraulic medium can flow out of the second operating chamber 48 to the storage container 57. The sheet metal holding force is controlled by the pressure control arrangement 67 in the second hydraulic circuit 56. The control arrangement 67 is controlled by the control unit 70 in such a way that a desired pressure is obtained in the operating chamber 53 which results in the setting of the desired metal sheet holding force. In this way, the metal sheet holding force remains constant also with a continuing inward movement of the piston rod 33. This means that during the forming of the metal part B the metal sheet holding force generated between the upper tool part 14 and the lower tool part 15 is always provided by the sheet metal support ring 25.

In a modified embodiment, in the second switching position II the first hydraulic line 26 or, respectively, the first operating chamber 47 may be blocked. In this embodiment the pressure in the second operating chamber 48 is controlled by the pressure control valve 63. Then a suction inlet line needs to be connected to the first operating chamber to make a piston rod movement possible.

When the forming procedure is completed, the upper tool part 14 can again move away from the lower tool part 15. The drawing cushion 20 or, respectively, the hydraulic cylinder 23 is then no longer controlled for an adjustment of the desired metal sheet holding force, but is again operated under position control. The first control valve 61 switches either to the first switching position I for causing a return movement of the piston rod or to the third switching position for performing an ejection movement. Wherein the piston rod 33 is moved outwardly and the hydraulic medium is sucked into the third operating chamber 53. For a sufficient suction movement only a small suction pressure in the range of 5 to 15 bar is needed in the second hydraulic circuit 56. In contrast, the pressure store 60 of the first hydraulic circuit 55 provides for the movement of the piston rod 33 a pressure in the area of 200 bar, which permits a rapid piston road movement.

Figure 3:
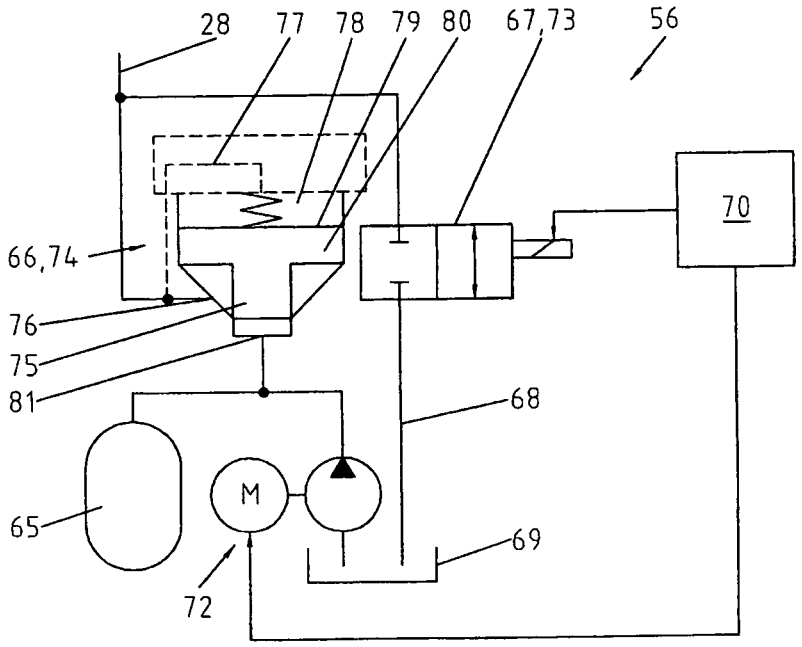
FIG. 3 shows an exemplary embodiment for a hydraulic circuit in the form of a block diagram which circuit is connected to the third operating chamber of the hydraulic cylinder.
Figure 4:
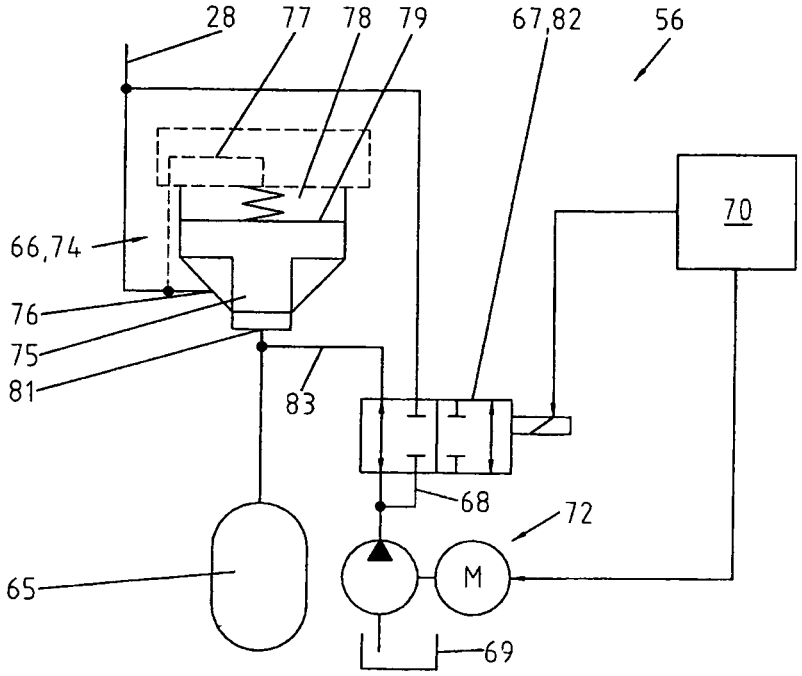
FIG. 4 shows a modified exemplary embodiment of the hydraulic circuit connected to the third operating chamber of the hydraulic cylinder in the form of a block diagram.

FIGS. 3 and 4 show two exemplary embodiments for the realization of the second hydraulic circuit 56 in a highly simplified manner where only the most important components are shown.

The second hydraulic circuit 56 may include its own motor pump unit 72 for replenishing the hydraulic reservoir 65. The pressure control arrangement 67 is, in the exemplary embodiment of FIG. 3, formed by a 2/2 way valve 73 which can be electrically switched over by the control unit 70. When the pressure in the third hydraulic line 28 and as a result in the third operating chamber 53 goes to a variably predeterminable threshold value, the 2/2 way valve 73 is opened for a short time in order to release hydraulic medium to the storage container 69 and to thereby reduce the pressure. The threshold value corresponds under pressure control operation to the desired sheet metal holding force. When the piston rod 33 is moved into the cylinder during the position or movement control the pressure control arrangement 67 opens in order to permit the piston rod movement.

The inlet check valve 66 is preferably a pressure-controlled safety valve 74. Via an inlet 81, the pressure of the hydraulic reservoir 65 is effective on the stem 75 of the safety valve 74. An outlet 76 of the safety valve 74 is connected to the third hydraulic line 28. The hydraulic pressure effective at the outlet 76 is transmitted, via a control line 77 to a control chamber 78, which is delimited by a control surface 79 of a piston 80 connected to the stem 75. The control surface 79 is substantially larger than the front face of the stem 75 associated with the inlet 81. If the pressure in the control line 77 and consequently at the outlet 76 is sufficiently large, the stem is moved by the pressure in the control chamber 78 in a closed position whereby the inlet 81 is separated from the outlet 76 of the safety valve 74. When the pressure in the control line 77 drops, the stem 75 opens a communication path between the inlet 81 and the outlet 76 so that a pressurized hydraulic medium can flow from the reservoir 65 via the inlet 81 and the outlet 76 to the third hydraulic line 28. When subsequently, the pressure at the outlet 76 and consequently in the control line 77 has sufficiently increased, the safety valve 74 closes again. In this way the intake of hydraulic fluid into the third operating chamber during outward movement of the piston rod 33 is achieved. During the pressure control, the hydraulic pressure in the third operating chamber 53 is sufficiently large to keep the safety valve 74 in the closed position. Hydraulic fluid can then flow out of the second hydraulic line 28 only via the pressure control arrangement 77 and, for example, the 2/2 way valve 73.

FIG. 4 shows a modified exemplary embodiment of the second hydraulic circuit 56, wherein energy recuperation by a generator operation of the motor-pump unit is provided. Instead of the 2/2 way valve, a 4/2 way valve 82, for example, can be used herein as pressure control arrangement 67. The motor-pump unit 72 is disposed herein in the return line 68. The return line 68 branches at the 4/2 way valve 82 and is connected to two connections. At the other side of the 4/2 way valve 82, there is a supply line 83 which extends to the inlet 81 of the safety valve 74 and, at the same time, to the hydraulic reservoir 65 while the other connection is connected to the third hydraulic line 28. In one switching position, the supply line 83 is connected to the motor-pump unit 72; whereas the connection to the third hydraulic line 28 is blocked. In the other switching position, the connection between the supply line 83 and the motor pump-unit 72 is interrupted, whereas the motor-pump unit 72 is connected to the third hydraulic line 28.

With the connection between the motor pump unit 72 and the supply line 83 established, hydraulic medium can be supplied to the hydraulic reservoir 65 for pressure storage therein. From the third operating chamber 53, hydraulic fluid cannot flow out via the third hydraulic line 28 since the return line 68 is blocked and the safety valve 74 does not permit a hydraulic medium return flow. In the other switch position, the connection of the motor-pump unit 72 to the hydraulic reservoir 65 and the safety valve 74 is interrupted and hydraulic medium can return to the storage container 69 for pressure reduction in the third operating chamber 53 via the third hydraulic line 28, the return line 68 and the pump of the motor-pump unit 72. In this way, the returning hydraulic medium drives the pump. The electric motor can then be operated in a generator mode wherein it produces electricity which can, for example, be stored in a battery. In this way, the energy efficiency of the drawing cushion 20 or, respectively, the drawing press is further improved.

In a modification of the embodiment shown in FIG. 4, a connecting line with a control valve may extend parallel to the pressure control arrangement 67 and extend between the third hydraulic line 28 and the storage container 69 as it is shown in FIG. 3. The fluid flow from the third operating chamber 53 can then be controlled independently of the motor-pump unit.

If the cylinder arrangement 22 of the drawing cushion 20 includes several hydraulic cylinders 23, they can be controlled independently of one another. This offers the possibility to control the cylinders, so that at different locations of the sheet metal support ring 25 different positions and/or movements and/or metal sheet clamping forces can be obtained. This may be necessary in connection with complex forming processes, for example, in connection with vehicle body parts in the automotive industry.

Figure 5:
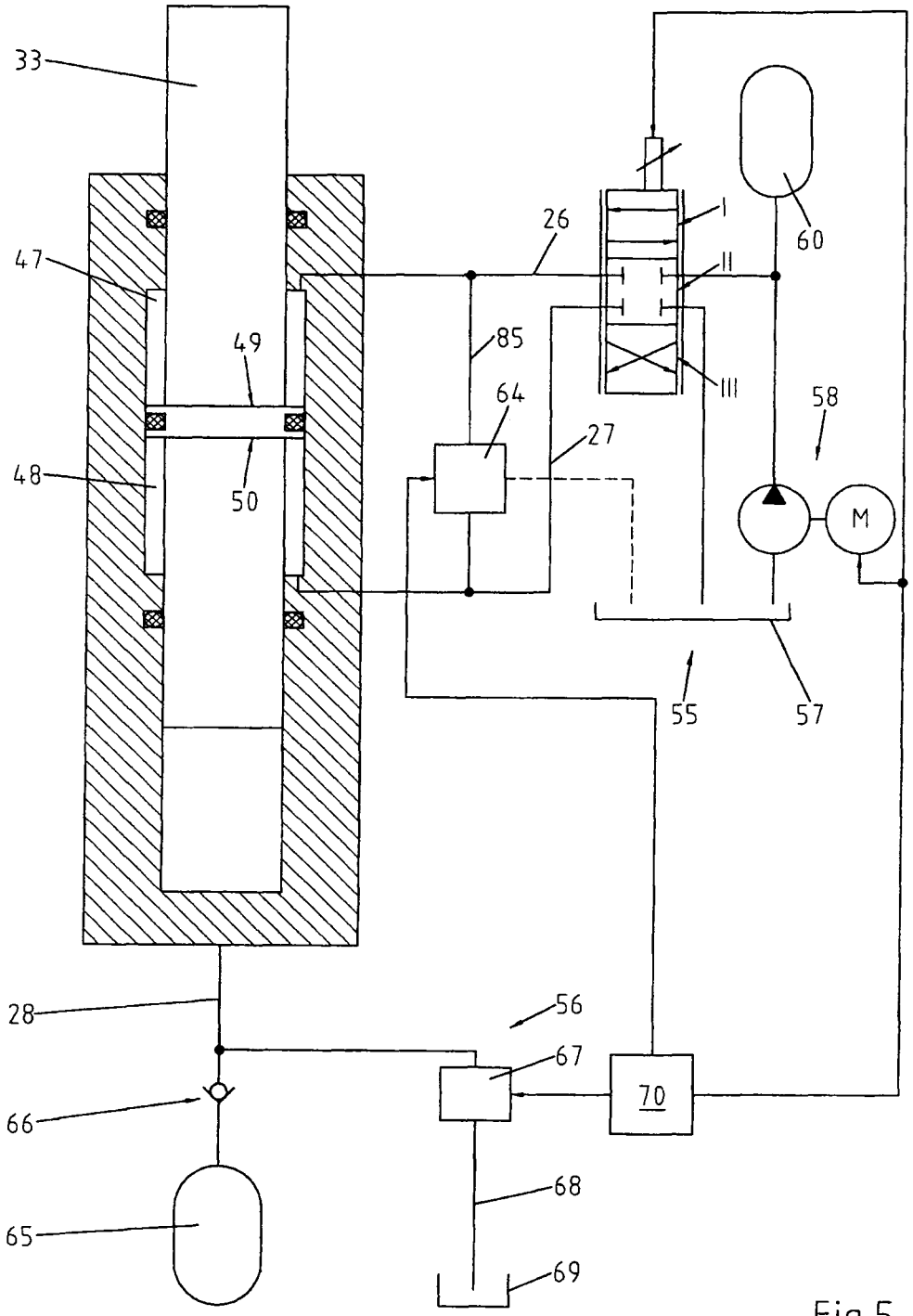
FIG. 5 shows a further exemplary embodiment of the hydraulic circuit connected to the hydraulic cylinder of the drawing cushion with a modified pressure control valve in the form of a block diagram and FIG. 6 shows the modified pressure control valve of FIG. 5 in the form of a block diagram.
Figure 6:
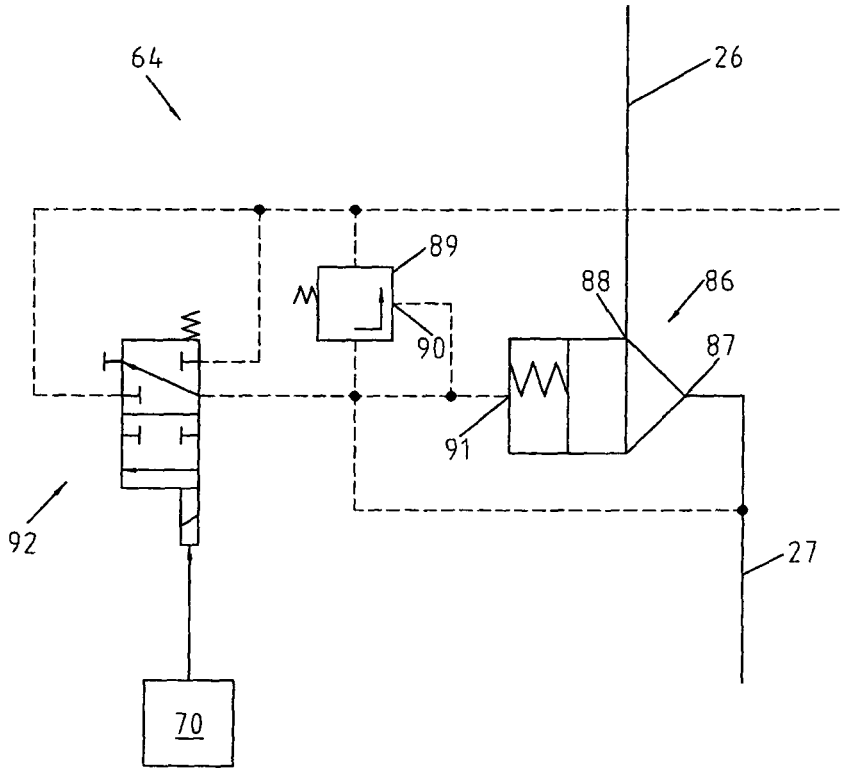

In FIG. 5, a modified exemplary embodiment of the first hydraulic circuit 55 is shown. The hydraulic cylinder, as well as the second hydraulic circuit 56, corresponds to the embodiment according to FIG. 2. Instead of the pressure valve 63, a pressure control arrangement 64 is provided which is installed in a connecting line 85 between the first hydraulic line 26 and the second hydraulic line 27. The pressure control arrangement 64 is controlled via the control unit 70. A detail representation of the pressure control arrangement 63 is shown in FIG. 6. In the connecting line 85, between the first and the second hydraulic line 26, 27, there is a main valve, for example, a cartridge valve 86 interposed, wherein its inlet 87 is connected to the second hydraulic line 27 and its outlet 88 is connected to the first hydraulic line 26. A pressure limiting valve 89 is connected with its inlet side to the second hydraulic line 27 and with its outlet side to the storage container 57. The control input 90 of the pressure limiting valve 89 is fluidically short-circuited with its inlet side. The inlet side of the pressure limiting valve 89 is further connected to a control input 91 of the cartridge valve 86. If the pressure increases in the second operating chamber 48 by an inward movement of the piston rod 33 above the switching threshold of the pressure limiting valve 89, the cartridge valve 86 is opened via the control input 91 and the connection on the connecting line 85 is established. In this way, the hydraulic fluid can be redirected from the second operating chamber 48 via the connecting line 85 to the first operating chamber 47. A supply of hydraulic fluid is not necessary herein. The control valve 61 is herein in a modified second switch position II wherein all lines are blocked by the control valve 61 (see FIG. 5).

Optionally, an additional multi-way valve 92 may be arranged parallel to the pressure limiting valve 89 which valve 92 is controlled by the control unit 70. This multi-way valve 92 is in the preferred embodiment according to FIG. 6 in the form of a 4/2 way valve. The multi-way valve could alternatively also be in the form of a 2/2 way valve. In its next position, the valve 92 is blocking whereas, in its activated switch position it short-circuits the pressure limiting valve 89 between the inlet thereof and the outlet. Such a fluidic short circuit results in a reduction of the pressure at the control input 91 of the cartridge valve 86 and establishes a fluidic connection between the two operating chambers 47, 48 via the then open connecting line 85. By opening the valve 92, the influence on the metal sheet holding force by pressures occurring in the operating chambers 47, 48 during the drawing process can be substantially reduced. The control signal for the activation of the valve 92 and, consequently, for the establishment of the hydraulic connection between the two operating chambers 47, 48 occurs by a certain occurrence. Such an occurrence may be, for example, the exceeding of a pressure gradient threshold valve in the second operating chamber 48. Alternatively or additionally, also one or several positions valves of the press plunger may be used as such an occurrence.

The invention resides in a hydraulic cylinder 23 for a hydraulic drawing cushion 20 of a drawing press 10. The hydraulic cylinder 23 includes a first operating chamber 47, a second operating chamber 48, and a third operating chamber 53. An annular piston 45 with a first piston surface area 49 and a second piston surface area 50 separates the first operating chamber 47 from the second operating chamber 48. The first and the second piston surfaces 49, 50 have the same size. A front surface of the piston rod 33 forms a third piston surface 54 which is larger than the first and second piston surfaces. The third piston surface 54 delimits the third operating chamber 53 of the hydraulic cylinder 23. The first and the second operating chambers 47, 48 are provided for controlling the position and/or the movement of the piston rod 33. The third operating chamber 53 serves to control the metal sheet clamping force of the drawing press via the piston rod 33. The metal sheet clamping force is adjusted by controlling the hydraulic pressure in the third operating chamber 53. Herewith a compact hydraulic cylinder 23 is provided with two operating chambers 47, 48 for the position and/or movement control of the piston rod 33 and with a pressure-controlled further operating chamber 53 for the adjustment of a metal sheet clamping force. All functions of the drawing cushion 20 are therefore combined in one hydraulic cylinder and are realized in simple and economical manner by the separation into different operating chambers 47, 48, 53.

LISTING OF THE REFERENCE NUMERALS

10 drawing press
11 press frame
12 plunger
13 press drive
14 upper tool part
15 lower tool part
16 press table
20 hydraulic drawing cushion
21 floating plate
22 cylinder arrangement
23 hydraulic cylinder
24 pressure rods
25 metal sheet support ring
26 first hydraulic line
27 second hydraulic line
27*a* branch connection
28 third hydraulic line
29 hydraulic circuit
30 cylinder housing
31 internal cylinder space
32 cylindrical opening
33 piston rod
34 outer free end of 33
35 first seal arrangement
40 first cylindrical section of 31
41 second cylindrical section of 31
42 annular step
43 second seal arrangement
45 annular piston
46 piston seal
47 first operating chamber
48 second operating chamber
49 first piston surface
50 second piston surface
53 third operating chamber
54 third piston surface
55 first hydraulic circuit
56 second hydraulic circuit
57 storage container
58 motor-pump unit
59 pressure line
60 pressure store
61 control valve
62 return line
63 pressure control valve
64 pressure control arrangement
65 hydraulic reservoir
66 inlet suction check valve
67 pressure control arrangement
68 return line
69 storage container
70 control unit
72 motor-pump unit
73 2/2 way valve
74 safety valve
75 stem
76 outlet
77 control line
78 control chamber
79 control surface
80 piston
81 inlet
82 4/2 way valve
83 supply line
85 connecting line

86 cartridge valve
87 inlet of 86
88 outlet of 86
89 pressure limiting valve
90 control input
91 control output
92 one channel valve
A operating direction
B sheet metal part
D1 first diameter
D2 second diameter
D thickness of 45
I first switching position of 61
II second switching position of 61
III third switching position of 61

What is claimed is:

1. Hydraulic drawing cushion (20) of a drawing press (10), the drawing press (10) including an upper tool part (14) and a lower tool part (15), the hydraulic drawing cushion (20) for exerting a clamping force on a sheet metal part (B) for forming a formed metal part, comprising:

a cylinder arrangement (22) including a hydraulic cylinder (23) including a cylinder housing (30) having an internal cylinder space (31) including a first hydraulic operating chamber (47), a second hydraulic operating chamber (48), and a third hydraulic operating chamber (53), a piston rod (33) slidably supported in a cylinder opening (32) of the internal cylinder space (31), the piston rod (33) for connection with a metal sheet support ring (25) of the drawing press (10), between the first hydraulic operating chamber (47) and the second hydraulic operating chamber (48), an annular piston (45) is arranged which extends annularly around and attached to the piston rod (33), the annular piston (45) having a first piston surface (49) adjacent first hydraulic operating chamber (47) and having a second piston surface (50) adjacent the second hydraulic operating chamber (48), the first piston surface (49) and the second piston surface (50) are of essentially a same surface area and movable simultaneously together with the piston (33), the piston rod (33) having a front face which is an integral part thereof and housed within the cylinder opening (32) delimiting a third piston surface (54) having a surface area larger than either the first and the second piston surface (49, 50) and which defines an upper border of the third hydraulic operating chamber (53), a first hydraulic circuit (55) in hydraulic circuit connection with the first hydraulic operating chamber (47) and the second hydraulic operating chamber (48), a second hydraulic circuit (56) in hydraulic circuit connection with the third hydraulic operating chamber (53), the first hydraulic circuit (55) controls a position and/or movement of the piston rod (33) before the upper tool part (14) abuts the sheet metal part (B), the second hydraulic circuit (56) controls a sheet metal part (B) clamping force upon the upper tool part (14) abutting the metal sheet part (B), the hydraulic drawing cushion (20) is operated by a position and/or movement control before the upper tool part (14) abuts the metal sheet part (B), the hydraulic drawing cushion (20) is operated by a sheet metal part (B) clamping force control as soon as the upper tool part (14) abuts the sheet metal part (B), and, an electrically controllable control valve (61) connected in hydraulic circuit arrangement with the first hydraulic circuit (55) and the second hydraulic circuit (56), the electrically controllable control valve (61) in a first position (I) enables the position and/or movement control of the hydraulic drawing cushion (20) and the electrically controllable control valve (61) switches over to a second position (II) to enable the sheet metal part (B) clamping force control of the hydraulic drawing cushion (20) upon the upper tool part (14) abutting the metal sheet part (B).

2. Hydraulic drawing cushion (20) according to claim 1, wherein the surface area of the third piston surface (54) is larger than the surface area of either the first and the second piston surface (49, 50) by a factor of 3 to 10.

3. Hydraulic drawing cushion (20) according to claim 1, wherein the internal cylinder space (31) includes a first cylindrical section (40) having a first diameter (D1) and a second cylindrical section (41) having a second diameter (D2).

4. Hydraulic drawing cushion (20) according to claim 3, wherein the first and second hydraulic operating chambers (47, 48) are arranged in the first cylindrical section (40) and the third hydraulic operating chamber (53) is arranged in the second cylindrical section (41).

5. Hydraulic drawing cushion (20) according to claim 1, wherein the third hydraulic operating chamber (53) is hydraulically connected to an electrically controllable pressure control arrangement (67) for controlling the sheet metal part (B) clamping force.

6. Hydraulic drawing cushion (20) according to claim 1, wherein the third hydraulic operating chamber (53) is hydraulically connected to a suction check valve (66).

7. Hydraulic drawing cushion (20) according to claim 6, wherein the inlet suction check valve (66) is hydraulically connected to a hydraulic reservoir (65) which is under a pressure of from about 5 bar to about 15 bar.

8. Hydraulic drawing cushion (20) according to claim 5, wherein the electrically controllable control valve (61) having three switching positions including the first position (I) for the position/movement control of the hydraulic cushion (20), the second position (II) for the sheet metal part (B) clamping force control of the drawing cushion (20), and a third position (III) for providing an ejection movement of the drawing cushion (20) for ejecting the formed metal part.

9. Hydraulic drawing cushion (20) according to claim 8, further comprising an electrical control unit (70) for controlling the switching of electrically controllable control valve (61) and for controlling the electrically controllable pressure control arrangement (67) for obtaining a desired pressure in the operating chamber (53).

10. Hydraulic drawing cushion (20) according to claim 5, wherein the second hydraulic circuit (56) further includes a motor-pump unit (72) in hydraulic connection between the third operating chamber (53) and a hydraulic reservoir (65) and a storage container (69) and means for controlling a hydraulic fluid flow through the motor-pump unit (72) such that in one flow direction the motor-pump unit (72) acts as a motor and in the opposite flow direction the motor-pump unit (72) acts as generator for producing electricity.

11. Hydraulic drawing cushion (20) according to claim 1, wherein the cylinder arrangement (22) includes several hydraulic cylinders (23) each controllable independently from one another.

12. Hydraulic cushion (20) according to claim 1, wherein the first hydraulic circuit (55) includes a hydraulic fluid storage container (57) in hydraulic connection to a first motor-pump unit (58), the first motor-pump unit (58) having an outlet in operative connection with a pressure line (59), a first hydraulic line (26) is in hydraulic operative connection between the first hydraulic operating chamber (47) and the electronic control valve (61), a second hydraulic line (27,

27*a*) is in hydraulic operative connection between the second hydraulic operating chamber (48) and the electronic control valve (61), whereby the pressure line (59) can be selectively hydraulically connected to the first hydraulic operating chamber (47) or the second hydraulic operating chamber (48).

13. Hydraulic cushion (20) according to claim 12, wherein the first hydraulic circuit (55) further includes a pressure control valve (63) in hydraulic connection with the second hydraulic line (27, 27*a*) and the storage container (57), whereby when the pressure in the second operating chamber (48) exceeds a predetermined threshold value, the pressure control valve (63) opens thereby permitting hydraulic medium to flow from the second operating chamber (48) to the storage container (57).

* * * * *